US006050101A

United States Patent [19]

Liu

[11] Patent Number: 6,050,101

[45] Date of Patent: Apr. 18, 2000

[54] HIGH EER AIR CONDITIONING APPARATUS WITH SPECIAL HEAT EXCHANGER

[75] Inventor: Shin-Huei Liu, Taipei, Taiwan

[73] Assignee: Nutec Electrical Engineering Co., Ltd., Taipei, Taiwan

[21] Appl. No.: 09/165,741

[22] Filed: Oct. 5, 1998

[51] Int. Cl.[7] ..... F25B 47/00

[52] U.S. Cl. ..... 62/280; 62/305

[58] Field of Search ..... 62/305, 315, 316, 62/279, 280

[56] References Cited

U.S. PATENT DOCUMENTS

| | | | |
|---|---|---|---|
| 1,798,824 | 3/1931 | White | 62/305 |
| 2,672,024 | 3/1954 | McGrath | 62/305 |
| 3,170,303 | 2/1965 | Rannenberg et al. | 62/305 |
| 3,613,392 | 10/1971 | Tucci | 62/184 |
| 4,438,635 | 3/1984 | McCoy | 62/305 |
| 4,935,169 | 6/1990 | Ernst | 261/153 |
| 5,444,991 | 8/1995 | Cox | 62/305 |

*Primary Examiner*—Henry Bennett
*Assistant Examiner*—Melvin Jones
*Attorney, Agent, or Firm*—Rosenberg, Klein & Lee

[57] ABSTRACT

A high EER air conditioning apparatus with a special heat exchanger of a condensing unit having a water evaporating system composed of a plurality of thin water-holding layers of porous hydro material coated on the heat conducting surfaces of metal plates and medium coils in the exhaust air passages to provide an extra cooling efficiency to cool the medium to an extreme low temperature due to the water been evaporated by the blow of the exhaust air thereby, in which a low compression ratio compressor of low pressure will be enough to liquefy the medium in such a low temperature so as to save a large consumption power of the compressor for obtaining a high EER therefor.

5 Claims, 7 Drawing Sheets

HIGH EER AIR CONDITIONING APPARATUS WITH SPECIAL HEAT EXCHANGER

CROSS-REFERENCE TO RELATED APPLICATIONS

This is a continuation-in-part application of application Ser. No. 08/728,140, filed on Oct. 9, 1996 and entitled High ERR Air Conditioning Apparatus With Special Heat Exchanger, now abandoned.

FIELD OF THE INVENTION

The present invention relates to an air condition apparatus having a high EER (Energy efficiency ratio) up to 4 Kcal/Hr-W particularly to an air condition apparatus with special heat exchanger which sufficiently uses the energy of air flow to evaporate the water in a wet thin layer of porous hydro material coated on the heat conducting surfaces of air flow passages for absorbing an extra large quantity latent heat of water evaporation from the working medium to obtain a low temperature much lower than that of conventional condensers therefore a lower critical pressure is needed to liquefy the working medium of a lower temperature which saves a large consumption power of the compressor in the working medium system so as to provide a high EER therefore.

BACKGROUND OF THE INVENTION

Air conditioners are now widely used for conditioning the air within a building (for example, a house or an office, etc.). However, the conventional air conditioners have the disadvantages of low EER, high noise and not always introducing fresh air into the room space. There are a number of designation been disclosed a water spray system used in a heat exchanger unit, for example: Nelson of U.S. Pat. No. 4,406,138 discloses a water spray system 46 for spraying chilled water to an outdoor condensing unit 2, however Nelson did not disclose any porous hydroscopic material for holding the water. Penington, U.S. Pat. No. 2,536,018 discloses a porous material (see FIG. 7) which is formed of a thick cylindrical pad 49 to bury the whole medium coil 48 therein and forced the air passing through the pad 49 from a hollow center of the pad 49 by a blower 72, however Penington did not disclose a thin layer of porous hydro material coat on heat conducting surfaces furthermore, the blower 72 consumes a large power consumption it will decrease the EER much lower.

Since the EER of an air conditioning apparatus is directly depend on the consumption power of the compressor which the consumption power of the compressor is directly depend on the efficiency of the heat exchanger employed therewith. The present invention therefore is aimed at providing an improved air conditioning apparatus to eliminate and/or obviate the aforementioned problems.

SUMMARY OF THE INVENTION

An air conditioner incorporating the air conditioning apparatus in accordance with the present invention is characterized in that it consists of evaporating portion, an airflow-energy aided condensing portion, a low compression-ratio compressor and an auxiliary water spray system.

Since the present invention is related to using the energy of air to heat or cool the working medium, fresh air can be continually introduced into indoor space during the operation. Furthermore, since the heat flow rate per unit area of heat conducting surface exposed in the air flow of the condensing portion and the evaporating portion is relatively high, the evaporating portion together with the condensing portion constitutes a high-efficiency heat exchanger. Thus, the thermal efficiency of the present invention is very high. This means that the air conditioner incorporating the air conditioning apparatus in accordance with the present invention has an EER which is much higher than that of the conventional air conditioner.

An objective of the present invention is to provide an air conditioning apparatus which his a high EER (energy efficiency ratio).

Another objective of the present invention is to provide an air conditioning apparatus which always introduces fresh air into the room space during operating.

A further objective of the present invention is to provide an air conditioning apparatus which will generate low noise during operation.

Other objectives, advantages, and novel features of the invention will become more apparent from the following detailed description in conjunction with the accompanying drawings.

DETAILED DESCRIPTION OF THE PREFERRED EMBODIMENT

Figure 1:
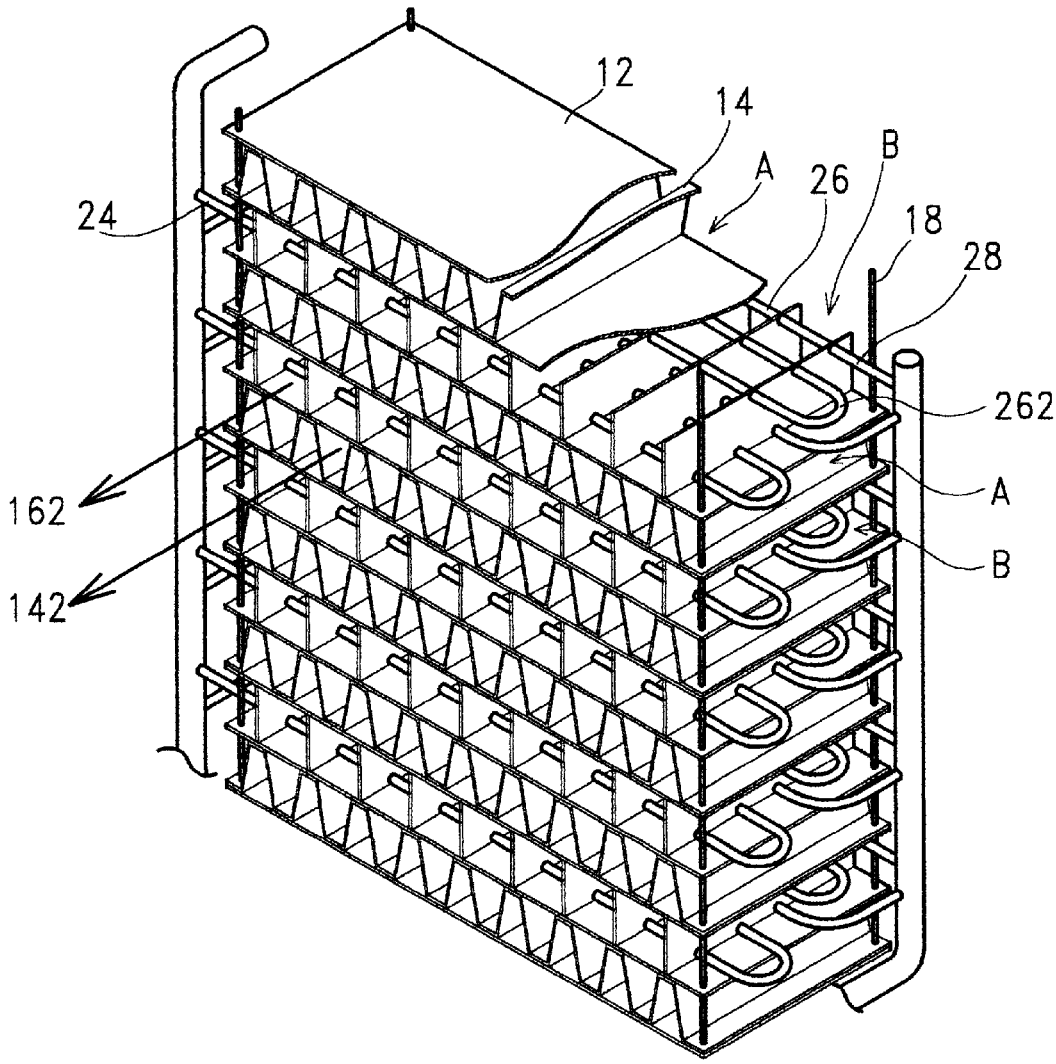
FIG. 1 is a perspective view of a basic heat exchanger used in an evaporating unit of the present invention.
Figure 1A:
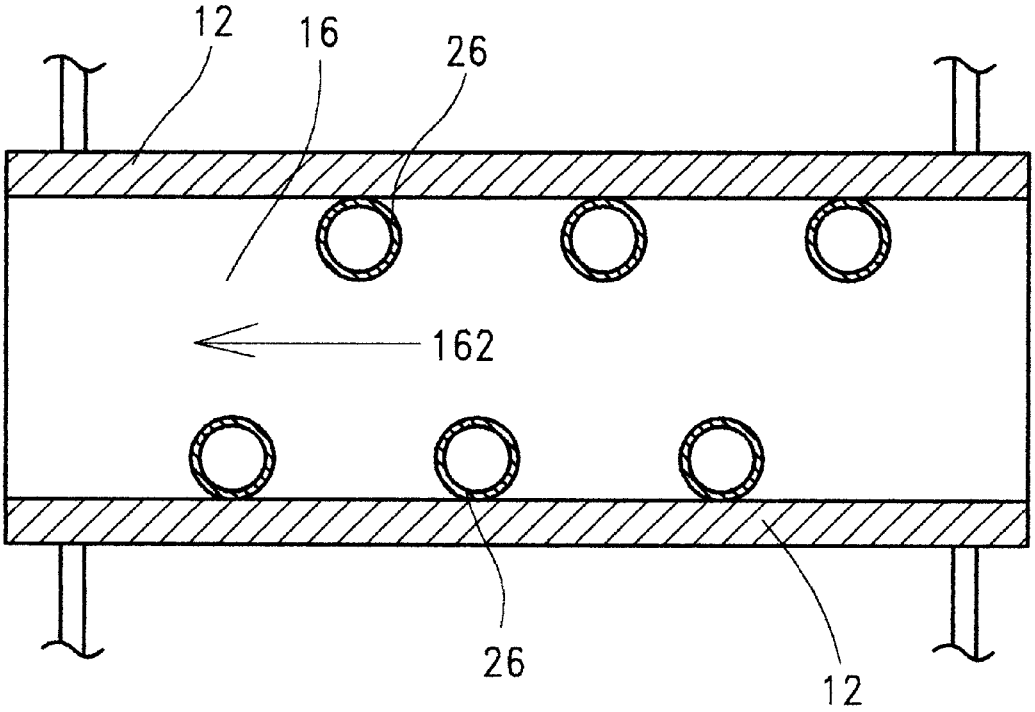
FIG. 1A is a partial cross-sectional view of a space B according to FIG. 1.
Figure 2:
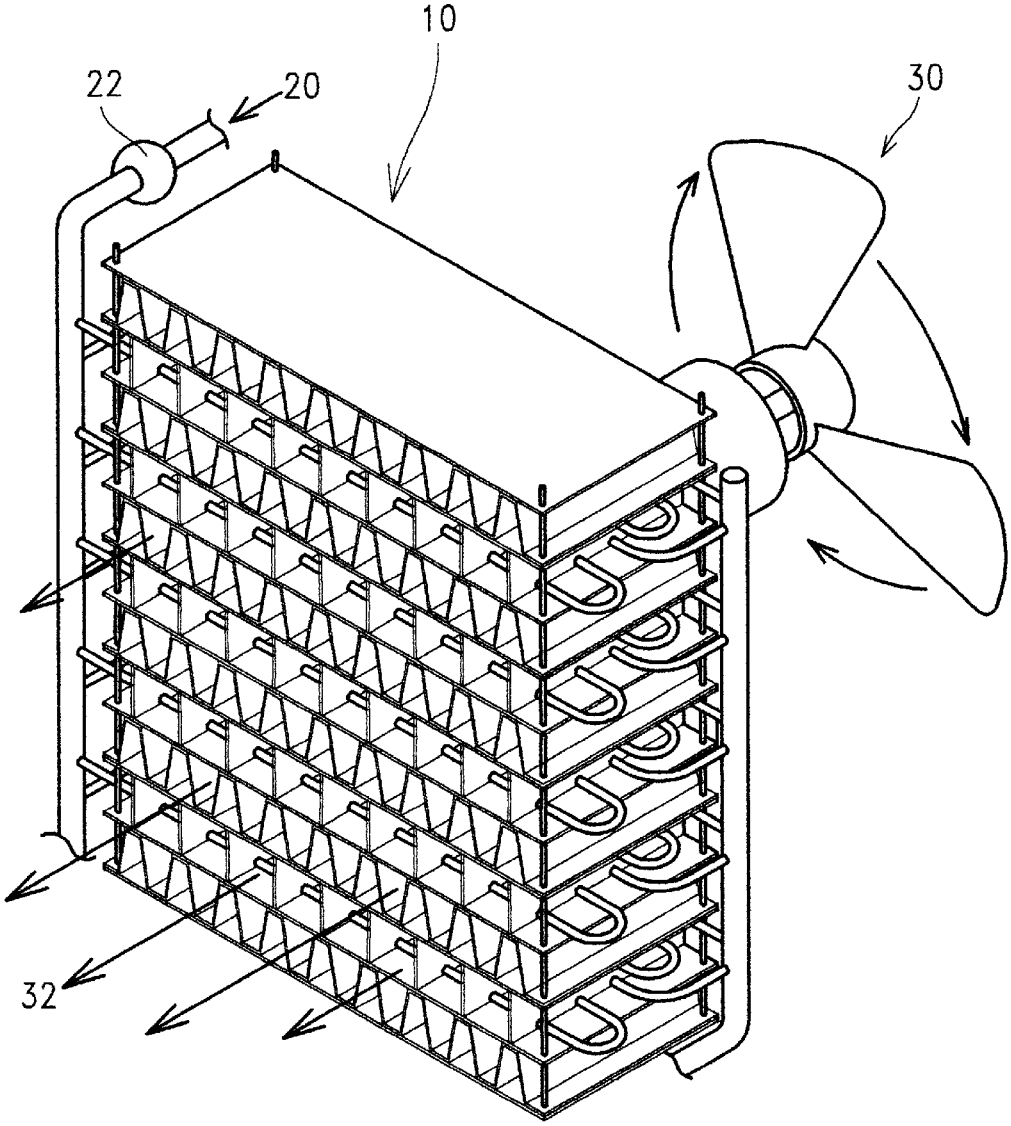
FIG. 2 is a perspective view of a whole set evaporating unit of the present invention.

Please refer to FIG. 1, 1A and FIG. 2, which shows a preferable embodiment of heat exchanger 10 used in an evaporating unit of the present invention comprising a plurality of rectangular heat conductive metal plates 12 horizontally fastened in parallel by four fastening studs 18 to define two different groups of space as labeled A and B alternatively one over another;

in each space A, a wave-like metal plate 14 of heat conductive material disposed in contact with adjacent metal plates 12 thereof to form a plurality of air passages 142 for providing a large conducting area therewith in which the air flow 32 is delivered by a fan system 30 from outdoor environment.

In each space B, two rows of medium coil pipes 26 with at least three pipes in each row disposed laterally all through the longer side of the rectangular space B therein and connected by at least one "U" term connector 262 respectively disposed to either end of coil pipes to complete a coil therefore having a plurality of heat conductive metal fins 16 to support the upper row and the lower row of medium coil pipes respectively in contact with the adjacent metal plates 12, in which a plurality of second air passages 162 are formed between two rows of coil pipes 26 separated by the fins 16 to provide another large conducting area therefore.

Figure 5:
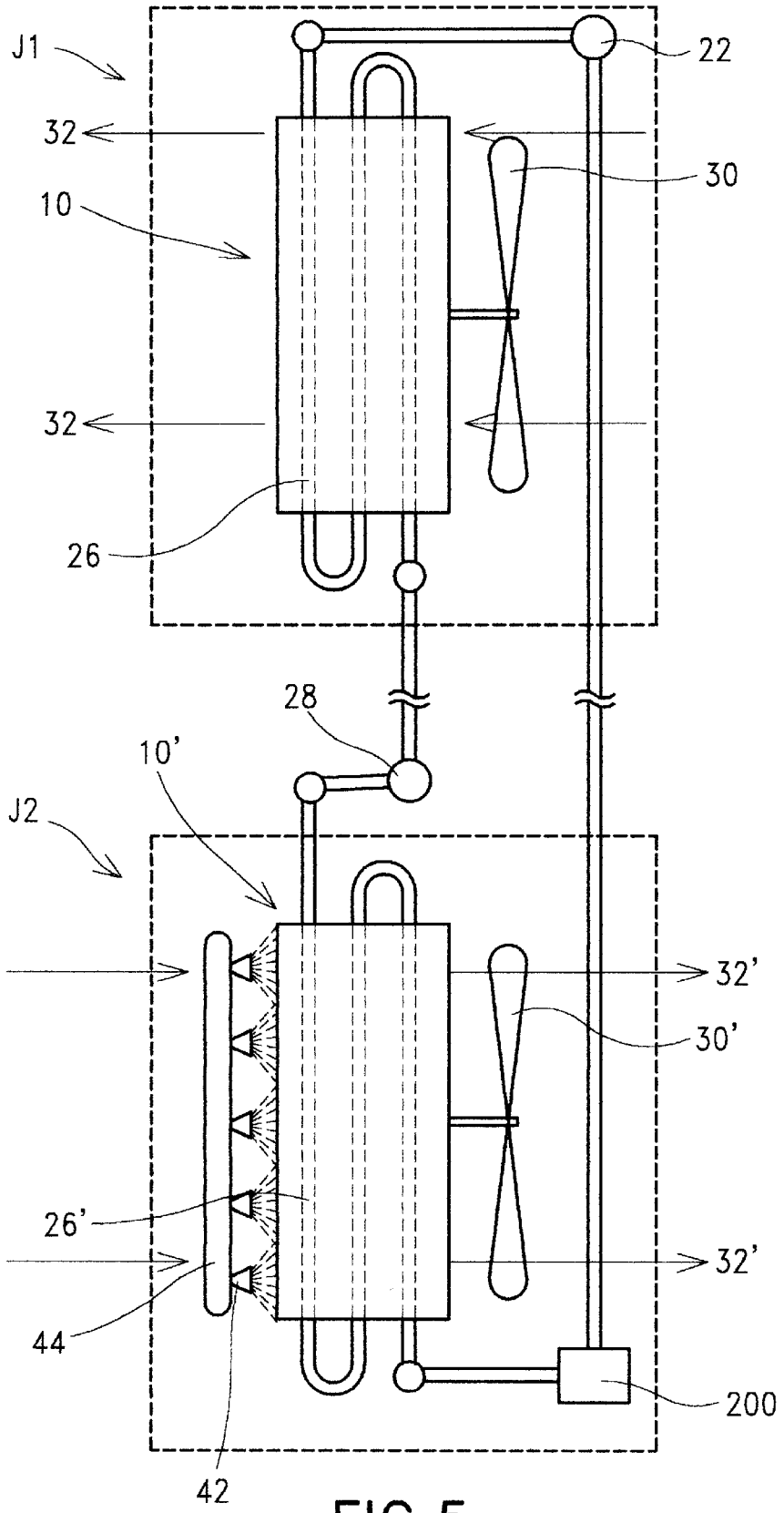
FIG. 5 is a schematic diagram of the thermal medium cycle worked in the present invention.

Refer to FIG. 5, during the air flow 32 is delivered from outdoor space in an environment temperature into the air passages 142 and 162 while the thermal medium 20 is delivered via an expansion valve 22 from a reservoir 200 and distributed into each coil 26 via a manifold 24 in a thin liquid state, and being evaporated into vapor state due to pressure releasing and volume expansion in the coils 26, in which a great quantity of latent heat of evaporation of medium 20 is needed to absorb from the air flow 32 conducted by the conductive metals via the conducting area in air passages coursed the air flow 32 to a cold low temperature introduced into the room space for cooling. Since the thermal efficiency of a heat exchanger is mainly depend upon the size of heat conductive area, therefore the present invention provides an extra large conductive area in a first air passages 142 and a second air passages 162 to reach a high efficiency.

Figure 3:
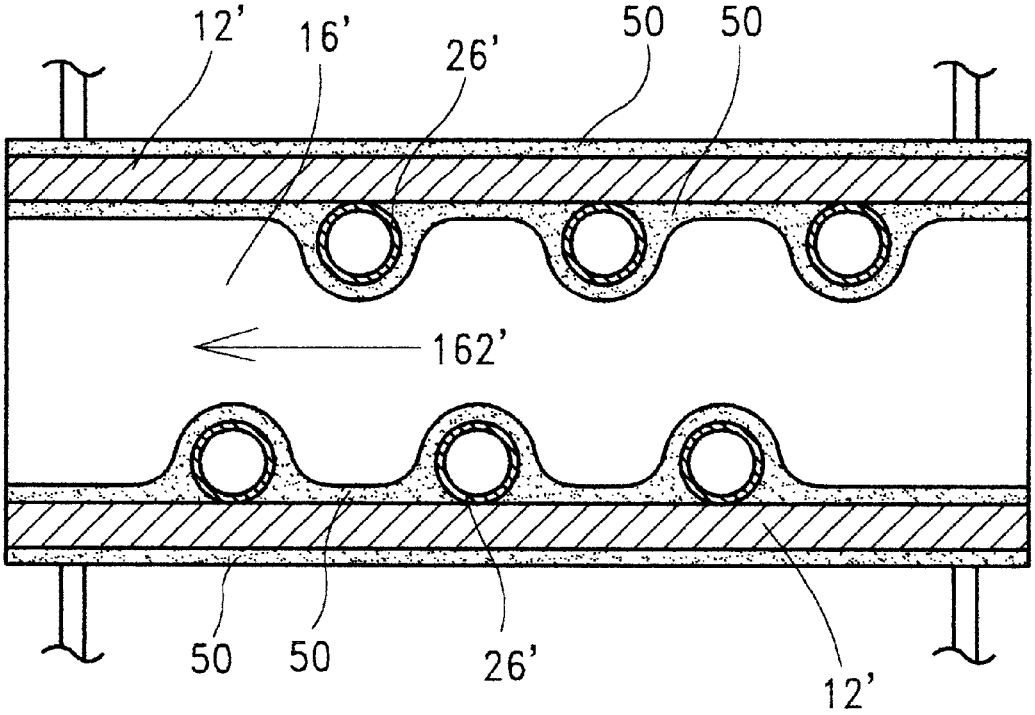
FIG. 3 is a partial sectional view of a space B of a condensing unit of the present invention.
Figure 4:
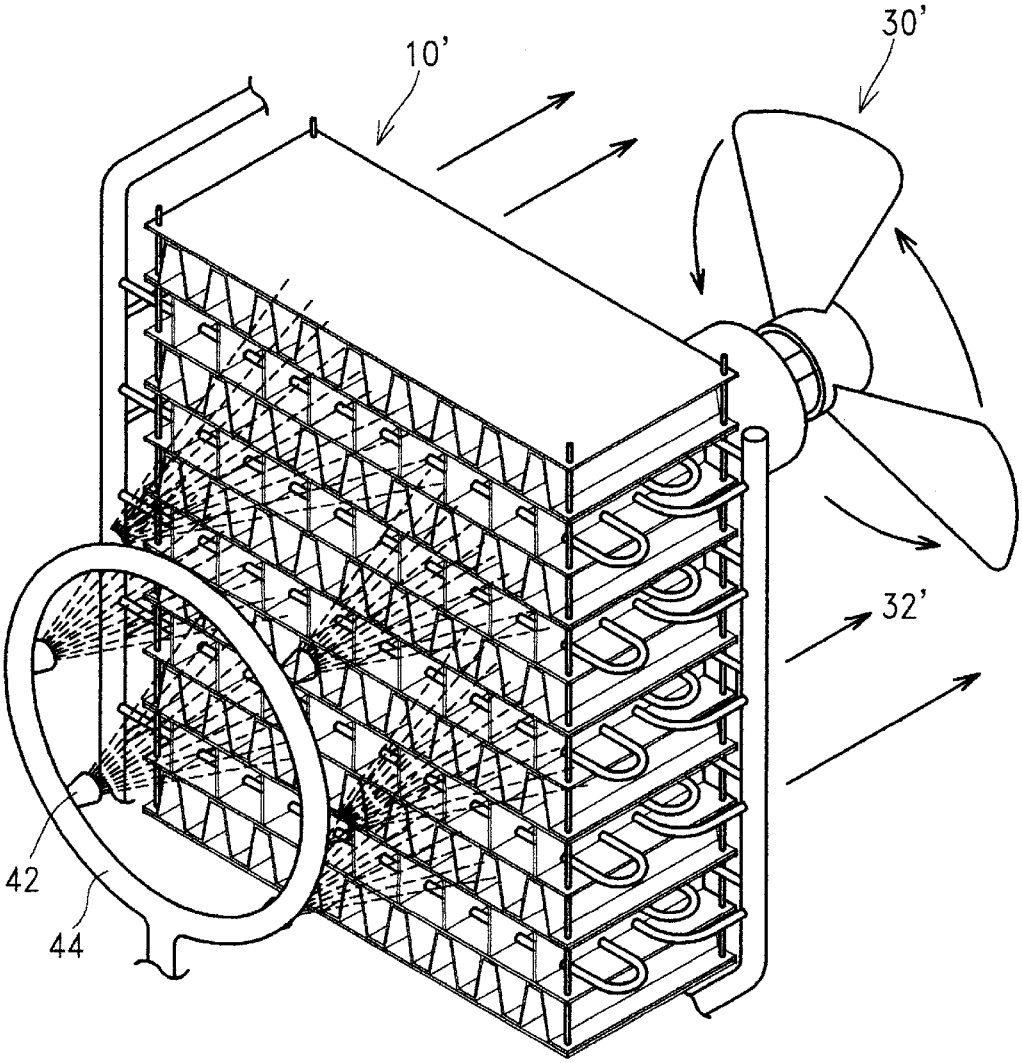
FIG. 4 is a perspective view of a whole set condensing unit of the present invention.

Now please refer to FIG. 3 and FIG. 4. A heat exchanger 10' used in a condensing unit J2 of the present invention having a water evaporating system 40 with a plurality of nozzles 42 disposed on a nozzle rack 44 which sprays the water particles into the air passages 142' and 162' in a direction of the exhaust air flow 32' drew to the outdoor space by a fan 30', in which the heat exchanger 10' has the same construction of a basic heat exchanger 10 used in the evaporating unit J1 described therebefore and characteristically having a plurality of water holding layers 50 (FIG. 4) of porous hydro material coated on all the exposed surfaces of the metal plates 12' and the coil pipes 26' thereof.

Refer to FIG. 5 again, during the working medium vapor 20 is compressed by a compressor 28 to a certain high pressure in a high temperature and guided into each coil 26' of the condensing unit J2 via a manifold 24' while the exhaust air flow 32' is drew out by a fan 30' the water held in the water holding layers 50 on the surfaces of the metal plates 12' and the coils 26' in the air passages 142' and 162' will be evaporated due to a low side-pressure occurs while the exhaust air flow 32' blows passing through in parallel with the surfaces of the thin water holding layers 50, in which a large quantity latent heat of water evaporation (539 cal/gr) has to absorb from the compressed vapor medium 20 via the metal plates 12' and the coils 26' so as to cool the medium 20 to obtain a low temperature around 30° C. which is about 15° C. lower than that of a conventional condensing unit where a low relative critical pressure of 12~13 kg/cm$^2$ able to liquefy the vapor medium 20 in such a low temperature, therefore a low compression ratio (2:1) compressor 28 of low power consumption will be sufficiently operating the working system of the present invention so as to provide a high EER therefore.

Figure 6:
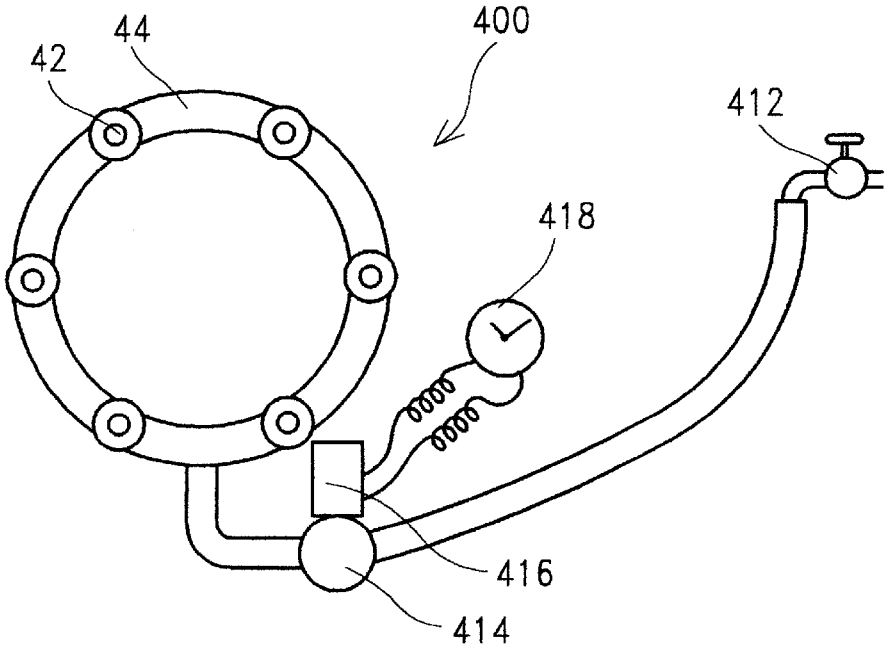
FIG. 6 and 7 show two different preferable embodiments of water supply used for the water spray system of the condensing unit of the present invention.
Figure 7:
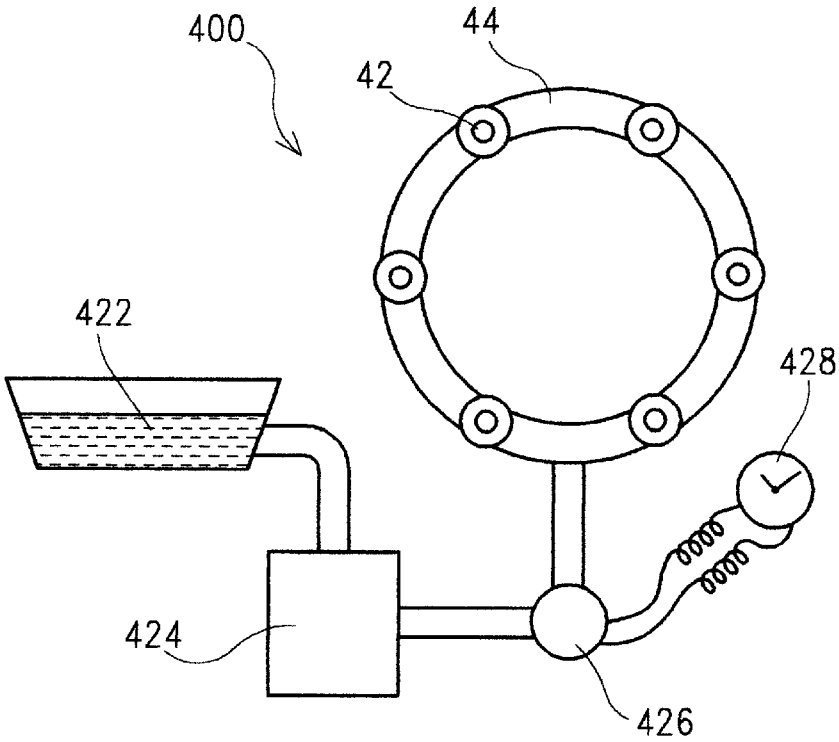

Please refer to FIG. 6 and 7, FIG. 6 is a preferable embodiment of a water spray system 400 which directly takes the water from a tap 412 of the city water having a valve 414 disposed to an inlet of the pipe rack 44 operated by a servo motor 416 to supply the water intermittently to the nozzles 42 for spraying, a timer 418 disposed on the common control panel of the apparatus for setting an adequate interval to control the quantity of the water sprayed by the nozzles 42 almost equal to the quantity of the water evaporated from the water holding layer 50.

FIG. 7 is another preferable embodiment of a water spray system 400 which takes the water from the condensed water of the evaporating unit J1 having a water collecting pan 422 disposed at a bottom under the heat exchanger 10 for collecting and guiding the condensed water into a reservoir 424, a pump 426 pumping the water intermittently from the reservoir 424 to the nozzles 42 through the piping rack 44, and a timer disposed on the common control panel for setting an adequate intermittence of the pumping operation to control the quantity of water spraying.

I claim:

1. A high EER air conditioning apparatus with special heat exchanger comprising:

an evaporating unit having a high efficiency heat exchanger to cool the air delivered by a fan system from outdoor space to a room space, said high efficiency heat exchanger including:

a. a plurality of rectangular heat conductive metal plates horizontally fastened in parallel by four studs to define two different groups of spaces namely space A and B alternatively one over another;

b. a wave-like metal plate disposed to each of said space A to form a plurality of air passages for providing a large heat conducting area therefore; and, c. two rows of medium coil pipes with at least three pipes in each row disposed laterally through each of said space B connected by U-turn connectors to build up two coils therein, and a plurality of metal fins to support an upper row and a lower row of said medium coil pipes respectively in contact with adjacent said rectangular metal plates, in which also a plurality of air passages are formed between two rows of said coil pipes and separated by said metal fins providing another large heat conducting area therefore to obtain high heat exchange efficiency;

a condensing unit having a water evaporating system added to a high efficiency heat exchanger having a structure like that of said evaporator to cool a working medium therein to a low temperature which is much lower than that obtained by conventional condensing units;

two fan systems, one fan system for introducing fresh air flow from an outdoor space to be cooled by said evaporating unit and flow into a room space, the other of said fan systems being for drawing exhaust air flow to the outdoor space through said condensing unit; and, a working medium system having a low compression ratio compressor of low pressure that can liquefy the working medium sufficiently in said condensing unit due to the working medium being cooled to said low temperature.

2. A high EER air conditioning apparatus with special heat exchanger comprising:

an evaporating unit having a high efficiency heat exchanger to cool the air delivered by a fan system from outdoor space to a room space;

a condensing unit having a water evaporating system added to a high efficiency heat exchanger having a structure like that of said evaporator, said water evaporating system including:

a. a plurality of water holding layers of thin porous hydro material coated all over surfaces of rectangular metal plates and coil pipes disposed in air passages of said heat exchanger of said condensing unit for holding water therein; and, b. a water spray system having a plurality of nozzles disposed on a water pipe rack to spray water particles onto said water holding layers in said air passages for supplying water which is continuously evaporated due to an exhaust air flow passing over surfaces of said water holding layers for absorbing a large amount of latent heat of water vaporization from the working medium to cool the working medium to a low temperature that is much lower than that obtained by conventional condensing units;

two fan systems, one fan system for introducing fresh air flow from an outdoor space to be cooled by said evaporating unit and flow into a room space, the other of said fan systems being for drawing exhaust air flow to the outdoor space through said condensing unit; and, a working medium system having a low compression ratio compressor of low pressure that can liquefy the working medium sufficiently in said condensing unit due to the working medium being cooled to said low temperature.

3. The high EER air conditioning apparatus according to claim 2 wherein said water spray system uses water supplied directly from a tap through a valve operated by a servo motor controlled by a timer.

4. The high EER air conditioning apparatus according to claim 2 wherein said water spray system is operated by a water pump pumping water from a water reservoir which collects condensed water from said evaporating unit.

5. A high EER air conditioning apparatus with special heat exchanger comprising:

an evaporating unit having a high efficiency heat exchanger to cool the air delivered by a fan system from outdoor space to a room space;

a condensing unit having a water evaporating system added to a high efficiency heat exchanger having a structure like that of said evaporator to cool a working medium therein to a low temperature which is much lower than that obtained by conventional condensing units;

two fan systems, one fan system for introducing fresh air flow from an outdoor space to be cooled by said evaporating unit and flow into a room space, the other of said fan systems being for drawing exhaust air flow to the outdoor space through said condensing unit; and, a working medium system having a low compression ratio compressor of low pressure that can liquefy the working medium sufficiently in said condensing unit due to the working medium being cooled to said low temperature, said low compression ratio compressor of low pressure is operated in a low compression ratio of 2:1 and a low pressure of 12–13 $kg/cm^2$ which consumes a large consumption power to obtain a high EER.

* * * * *